US006328602B1

(12) United States Patent
Yamasaki et al.

(10) Patent No.: US 6,328,602 B1
(45) Date of Patent: Dec. 11, 2001

(54) CONNECTOR WITH LESS CROSSTALK

(75) Inventors: Shuji Yamasaki; Kazuya Kikuchi, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/593,790

(22) Filed: Jun. 13, 2000

(30) Foreign Application Priority Data

Jun. 17, 1999 (JP) ..... 11-170384

(51) Int. Cl.[7] ..... H01R 13/648
(52) U.S. Cl. ..... 439/608
(58) Field of Search ..... 439/608, 609, 439/101, 108

(56) References Cited

U.S. PATENT DOCUMENTS

| | | | | |
|---|---|---|---|---|
| 5,174,770 | * | 12/1992 | Sasaki et al. | 439/108 |
| 5,620,340 | * | 4/1997 | Andrews | 439/608 |
| 5,645,436 | * | 7/1997 | Shimizu et al. | 439/108 |
| 5,660,551 | | 8/1997 | Sakurai | 439/108 |
| 5,775,947 | * | 7/1998 | Suzuki et al. | 439/608 |
| 6,083,047 | * | 7/2000 | Paagman | 439/608 |
| 6,116,926 | * | 9/2000 | Ortega et al. | 439/108 |
| 6,146,202 | * | 11/2000 | Ramey et al. | 439/608 |
| 6,210,227 | * | 4/2001 | Yamasaki et al. | 439/608 |

FOREIGN PATENT DOCUMENTS

| | | |
|---|---|---|
| 7-122335 | 5/1995 | (JP) . |
| 8-195250 | 7/1996 | (JP) . |
| 2811541 | 8/1998 | (JP) . |

* cited by examiner

*Primary Examiner*—Neil Abrams
*Assistant Examiner*—Thanh-Tam Le
(74) *Attorney, Agent, or Firm*—Foley & Lardner

(57) ABSTRACT

A connector includes signal sockets, and ground sockets. The signal sockets and the ground sockets are made of electrically conductive material and alternately arranged in a column direction and a row direction. Each of the signal sockets includes a contact lead section for an external signal lead to be connected, and a base section connected to the contact lead section of the signal socket. Also, each of the ground sockets includes a contact lead section for an external ground lead to be connected, a first extending section extending between one of the signal sockets which is arranged adjacent to the ground socket and one of two of the signal sockets which are arranged adjacent to the ground socket obliquely from the one signal socket, and a base section connected to the contact lead section of the ground socket and the first extending section. Here, the first extending section of the ground socket shields electromagnetic wave from the one signal socket to the one of the two signal sockets.

18 Claims, 12 Drawing Sheets

CONNECTOR WITH LESS CROSSTALK

BACKGROUND OF THE INVENTION

1. Field of the Invention

The present invention relates to a connector having signal sockets and ground sockets, and a method of manufacturing the same. More particularly, the present invention relates to a connector capable of reducing crosstalk between signal sockets, and a method of manufacturing the same.

2. Description of the Related Art

Along with the recent trend of higher performance and smaller size of electronic appliances, small-sized connectors for high density mounting are proposed. FIG. 1 is a perspective view showing an example of a conventional connector, FIG. 2 is a side sectional view, and FIG. 3 is a sectional view along line A—A in FIG. 2.

As shown in FIG. 1 to FIG. 3, a conventional connector is composed of signal sockets 10 and ground sockets 20 to change a direction of wiring lines from a printed circuit board (not shown) by 90 degrees. The signal socket 10 and the ground socket 20 are made of copper-alloy. In order to reduce crosstalk as much as possible when electromagnetic wave is radiated from the signal socket 10, the signal sockets 10 and the ground sockets 20 are alternately arranged in a matrix of a housing 30 made of a synthetic resin. That is, the ground sockets 20 are disposed around the signal socket 10 to surround the signal socket 10. Thus, the ratio of the signal sockets 10 and ground sockets 20 in the housing 30 is 1:1.

The signal sockets 10 and ground sockets 20 are identical in shape and used commonly. The socket is composed of a contact lead section 11, 21, a tail section 13, 23 and a lead terminal section 12, 22. The contact lead section 11, 21 extends in a horizontal direction and is connected with a male terminal (not shown) as a terminal to be connected. The lead terminal section 12, 22 extends in a downward direction and is inserted into a through-hole (not shown) in the printed circuit board. The tail section 13, 23 is provided between the contact lead section 11, 21 and the lead terminal section 12, 22 to be inclined in an oblique and downward direction. The tail section 13, 23 converts the connection direction from the direction of the contact lead section 11, 21 to the direction of the lead terminal 12, 22 by 90 degrees. The tail sections 13, 23 are longer at higher side, and shorter at lower side. The contact lead section 11, 21 is composed of a pair of opposing contact leads 11*a* and 21*a*. Each of the contact leads 11*a* and 21*a* is bent to have lead end portions 11*b* and 21*b* as a V-shaped portions so that the lead end portions opposes to each other. Thus, the male terminal can be held between the lead end portions 11*b* and 21*b* by their spring or elastic force. In such signal sockets 10 and ground sockets 20, the contact lead sections 11 and 21 are held in a state embedded in a housing main body 31. Also, the tail sections 13 and 23 are covered by a housing cover 32, and the lead terminal sections 12 and 22 project from the lower side of the housing cover 32.

A high speed transmission connector is disclosed in Japanese Laid Open Patent Application (JP-A-Heisei 7-122335). In this reference, the periphery of signal socket is surrounded by an L-shaped contact of a ground socket. Thus, since the signal contact is electromagnetically shielded by the ground contact, generation of crosstalk noise is suppressed, and deviation of propagation delay are decreased.

In a transmission circuit for transferring an electric signal, including a connector, the crosstalk often causes problems.

The effect of crosstalk is more serious when the frequency (rising time) of the electric signal is higher and the distance between adjacent signal socket 10 is shorter. In recent, owing to the increase of switching speed of a switching system, the frequency (rise time) of the electric signal is much higher, and by the reduction of size of electronic appliances, the distance between the signal sockets 10 is much shorter.

Therefore, in the conventional connector, the electromagnetic wave radiated from a signal socket 10 in an oblique direction cannot be shielded, and the crosstalk cannot be reduced sufficiently. In order to shield the electromagnetic wave in the oblique direction of the signal socket 10, it could be considered that the ground sockets 20 are disposed around the signal socket 10, i.e., in the vertical, lateral and oblique directions of the signal socket 10. In this case, however, the composition ratio of signal sockets 10 and ground sockets 20 becomes 1:4, and the number of signal sockets 10 is smaller so that high density can not be attained.

In conjunction with the above description, a connector is disclosed in Japanese Laid Open Patent Application (JP-A-Heisei 8-195250). In the connector (9) of the reference, insulator (3) is put between a ground line (2) and a signal line (1) such that the ground line (2) and the signal line (1) oppose to each other. The signal line (1) has an impedance to the ground. The impedance value is set to be equal to the impedance of a printed circuit board. In this way, the impedance matching is established and moreover cross talk noise is prevented.

Also, a connector is disclosed in Japanese Patent No. 2,811,541. This reference relates to the connector having a quasi-coaxial type structure in which a peripheral portion of a signal contact is surrounded by a ground contact. Each of the signal contact and the ground contact has one end which is connected with a printed circuit board, the other end which is held by a connector housing and is connected with a counter connector, and a direction conversion section bent between the ends from a direction of connection to the printed circuit board to a direction of insertion and drawing-out of the counter connector. A cylindrical insulator is provided for the direction conversion section of the signal contact to isolate between the direction conversion section of the signal contact and the direction conversion section of the ground contact.

SUMMARY OF THE INVENTION

Therefore, an object of the present invention is to provide a connector which has a small size and crosstalk can be reduced.

Another object of the present invention is to provide a connector which can shield electromagnetic wave between adjacent signal sockets.

Still another of the present invention is to provide a method of manufacturing the above connectors.

In order to achieve an aspect of the present invention, a connector includes signal sockets, and ground sockets. The signal sockets and the ground sockets are made of electrically conductive material and alternately arranged in a column direction and a row direction. Each of the signal sockets includes a contact lead section for an external signal lead to be connected, and a base section connected to the contact lead section of the signal socket. Also, each of the ground sockets includes a contact lead section for an external ground lead to be connected, a first extending section extending between one of the signal sockets which is arranged adjacent to the ground socket and one of two of the signal sockets which are arranged adjacent to the ground socket obliquely from the one signal socket, and a base section connected to the contact lead section of the ground socket and the first extending section. Here, the first extending section of the ground socket shields electromagnetic wave from the one signal socket to the one of the two signal sockets.

Also, the ground socket further includes a second extending section extending between the one signal socket and the other of the two signal sockets, and connected to the base section. In this case, the second extending section of the ground socket shields electromagnetic wave from the one signal socket to the other of the two signal sockets. Moreover, the first and second extending sections are desirably bent In a gull-wing form.

Also, the contact lead section of the ground socket includes a pair of contact leads opposing to each other, and each of the contact leads has a V-shape at a lead end portion thereof such that the contact leads are connected to the external lead with a spring force due to the V-shapes.

Also, the base section of each of the signal sockets and the ground sockets may extend straightly. In this case, the base section is inserted in a through-hole in a printed circuit board.

Also, each of the sockets may further include a lead terminal to be mounted to a printed circuit board, and a tail section connecting the base section of the socket. In this case, an uppermost ground socket of the sockets arranged for one column has a shield plate extending downwardly from the tail section thereof. The shield plate of the uppermost ground socket desirably covers the tail sections of the sockets arranged for one column to shield from electromagnetic wave.

In order to achieve another aspect of the present invention, a connector includes a ground socket, and three signal sockets arranged around the ground socket. Each of the signal sockets includes a contact lead section for an external signal lead to be connected, and a base section connected to the contact lead section of the signal socket. Each of the ground sockets includes a contact lead section for an external ground lead to be connected, a first extending section extending between a first one of the signal sockets and a second one of the signal sockets, a second extending section extending between the first signal socket and a third one of the signal sockets, and a base section connected to the contact lead section of the ground socket and the first extending section.

Here, the first extending section shields electromagnetic wave from the first signal socket to the second signal socket, and the second extending section shields electromagnetic wave from the first signal socket to the third signal sockets.

Also, the contact lead section of the ground socket includes a pair of contact leads bent to be orthogonal to the base section of the ground socket and extending from the base section of the ground socket. Each of the contact leads has a V-shape at a lead end portion thereof such that the contact leads are connected to the external lead with a spring force due to the V-shapes. The first extending section extends from the base section of the ground socket in parallel to one of the contact leads, and the second extending section extends from the base section of the ground socket in parallel to the other of the contact leads. The first and second extending sections are desirably bent in a gull-wing form.

Also, the base section of each of the signal sockets and the ground sockets may extend straightly such that the base section is inserted in a through-hole in a printed circuit board.

Also, each of the sockets may further include a lead terminal to be mounted to a printed circuit board and a tail section connecting the base section of the socket. In this case, an uppermost ground socket of the sockets arranged for one column desirably has a shield plate extending downwardly from the tail section thereof, such that the shield plate of the uppermost ground socket covers the tail sections of the sockets arranged for one column to shield from electromagnetic wave.

In still another aspect of the present invention, a manufacturing method of a connector having a socket, is attained by forming a T-slit in a central portion of a flat plate and I-slits at both sides of the T-slit to form a base section and first to fourth portions connected to the base section; by forming a V-shape at an end portion of each of the contact leads such that the contact leads hold a contact with an external lead inserted into the socket with elastic force of the V shapes; by bending the second and third portions orthogonally to extend in parallel to the first and fourth portions to form a pair of contact leads; and by bending the first and fourth portions in a direction opposite to the second and third portion to have a gull-wing form.

DESCRIPTION OF THE PREFERRED EMBODIMENTS

Hereinafter, a connector of the present invention will be described below in detail with reference to the attached drawings.

Figure 1:
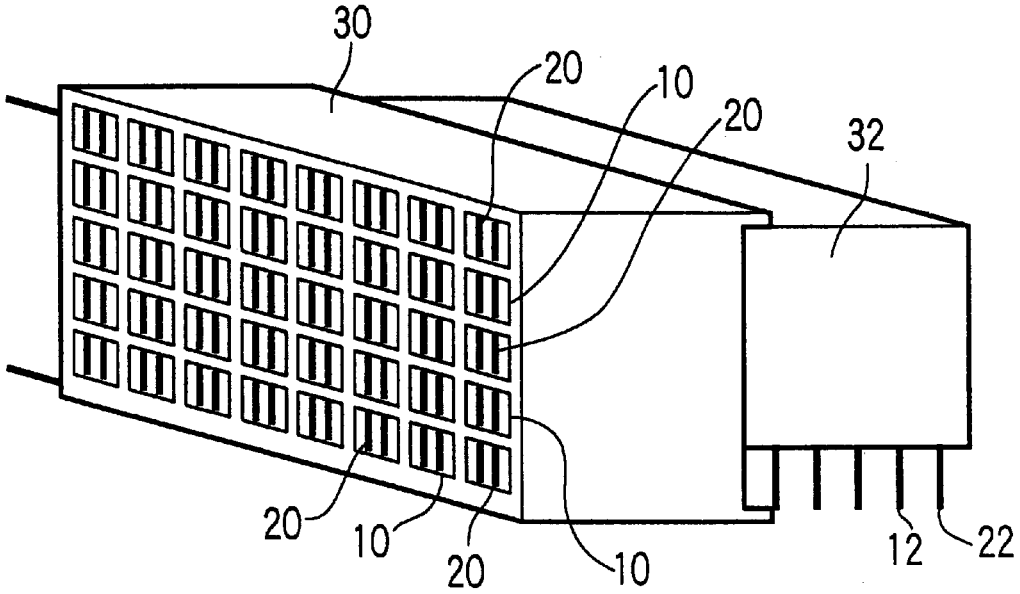
Fig.1 PRIOR ART
FIG. 1 is a perspective view showing an example of a conventional connector.
Figure 2:
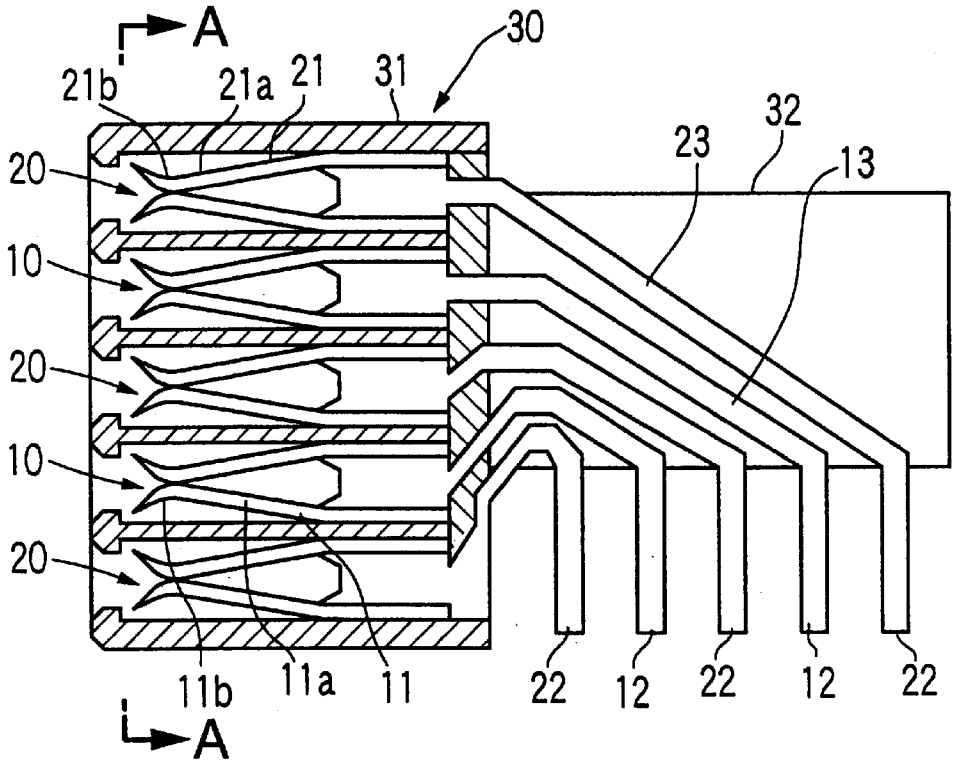
Fig.2 PRIOR ART
FIG. 2 is a sectional view showing the conventional connector.
Figure 3:
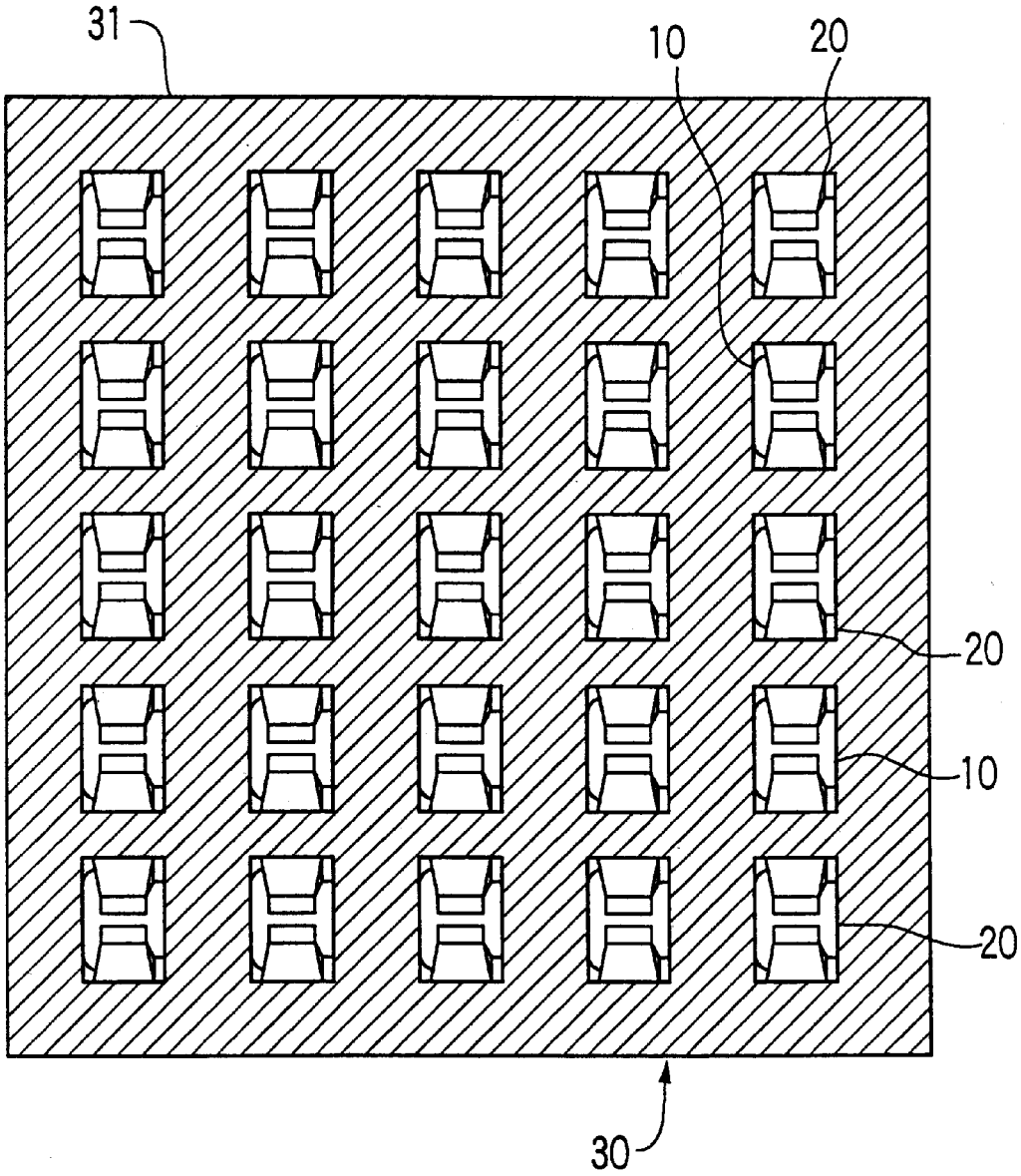
Fig. 3 PRIOR ART
FIG. 3 is a sectional view of the conventional connector along line A—A in FIG. 2
Figure 4:
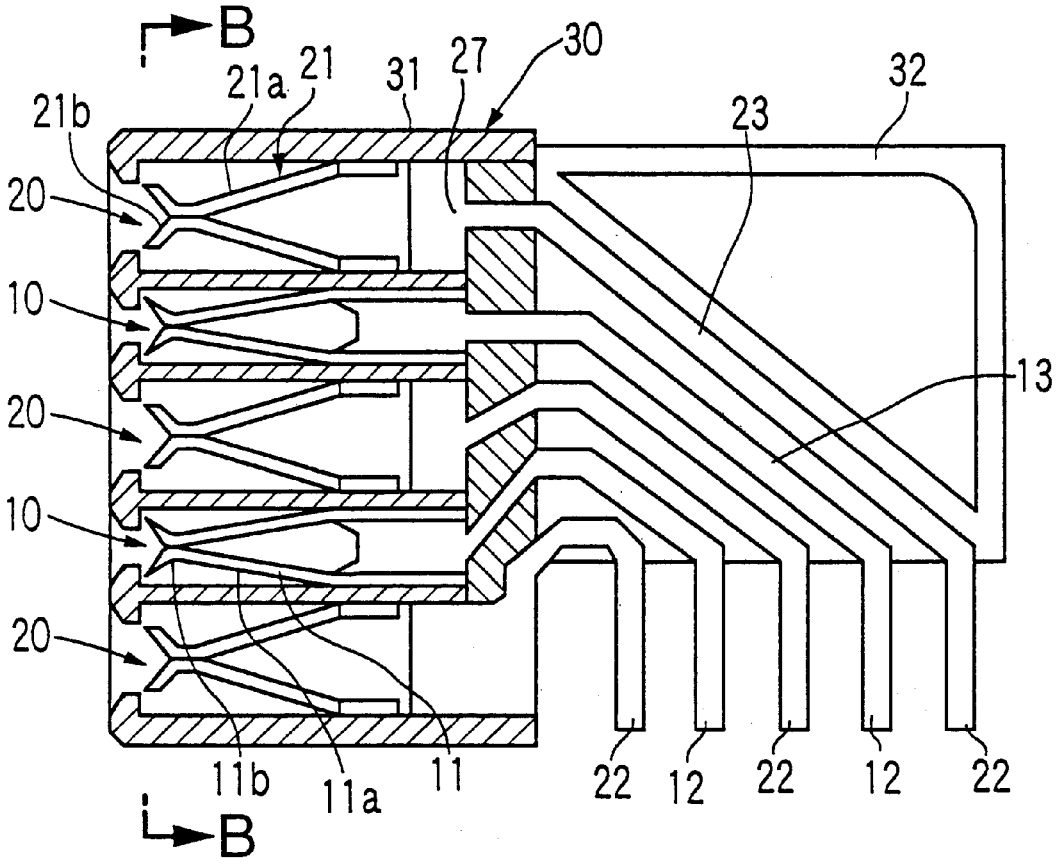
FIG. 4 is a sectional view showing a connector according to a first embodiment of the present invention.
Figure 5:
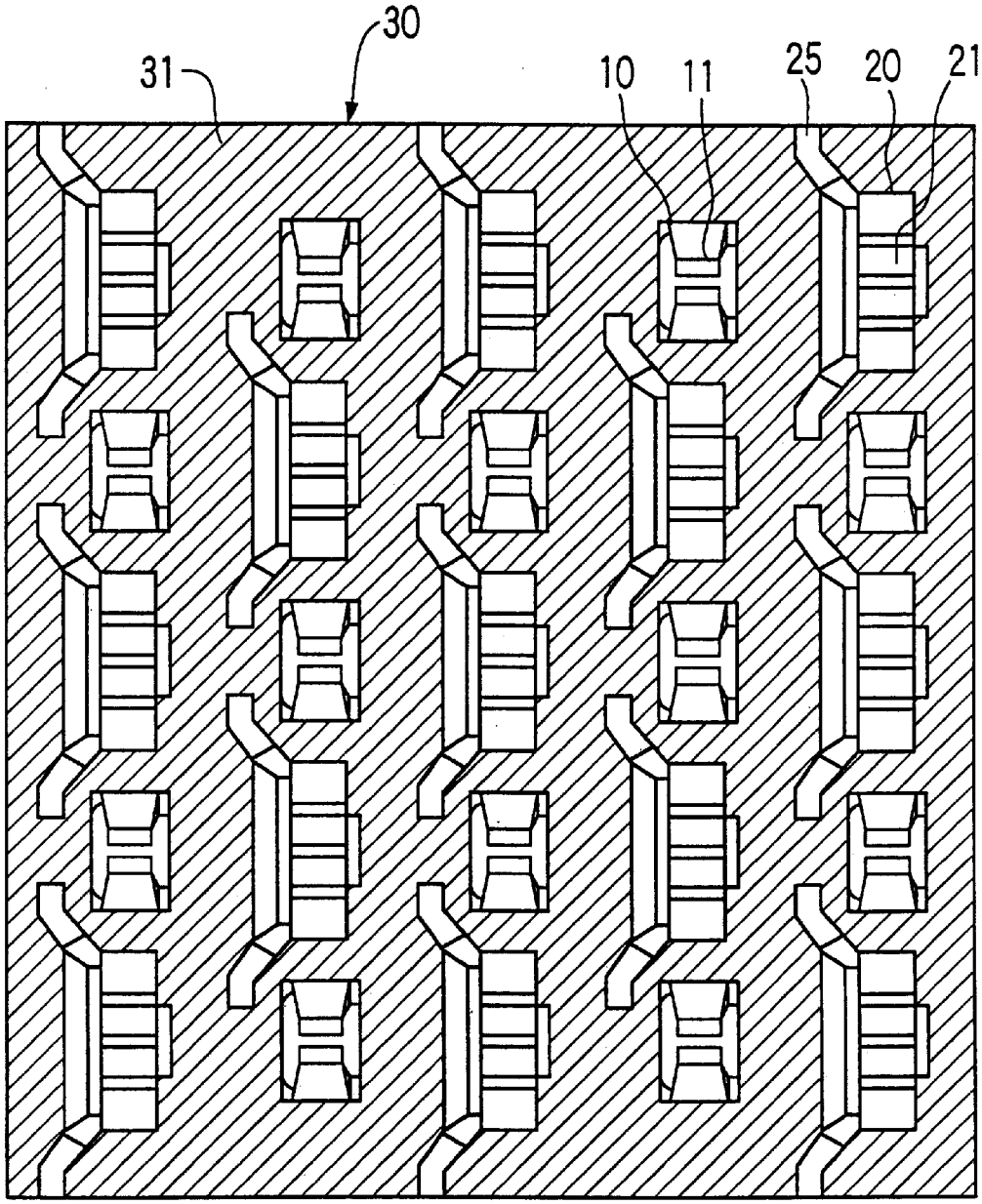
FIG. 5 is a sectional view showing the connector according to the first embodiment of the present invention along line B—B in FIG. 4.
Figure 6:
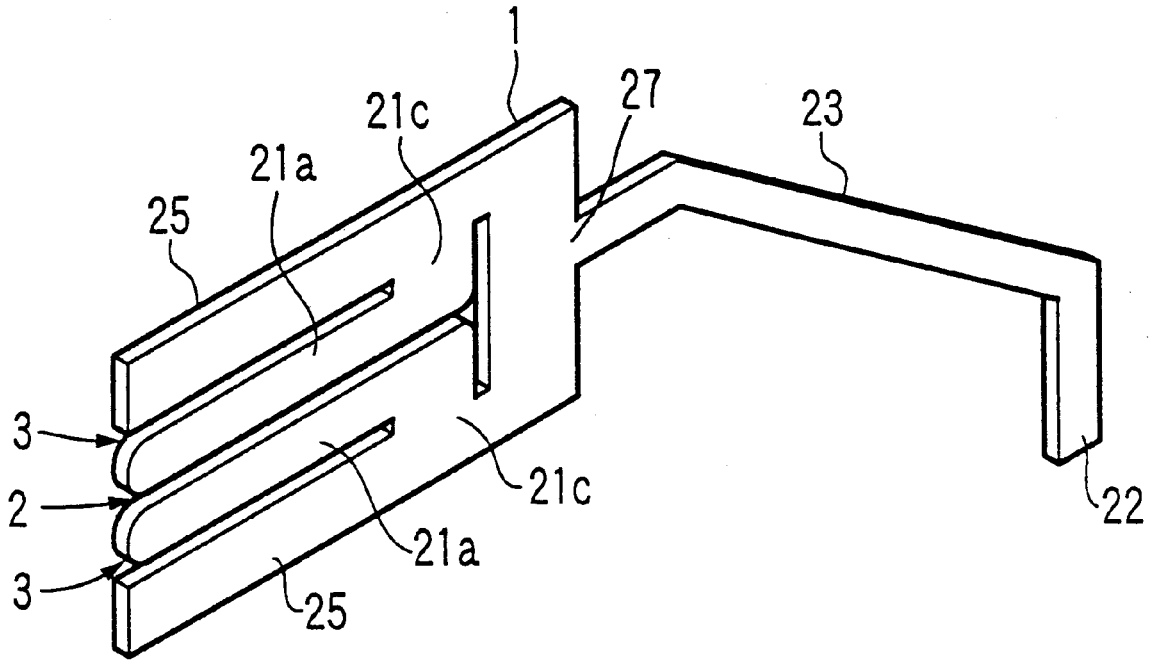
FIG. 6 is a perspective view showing a state of a ground socket in the manufacturing method of the connector according to the first embodiment of the present invention.
Figure 7:
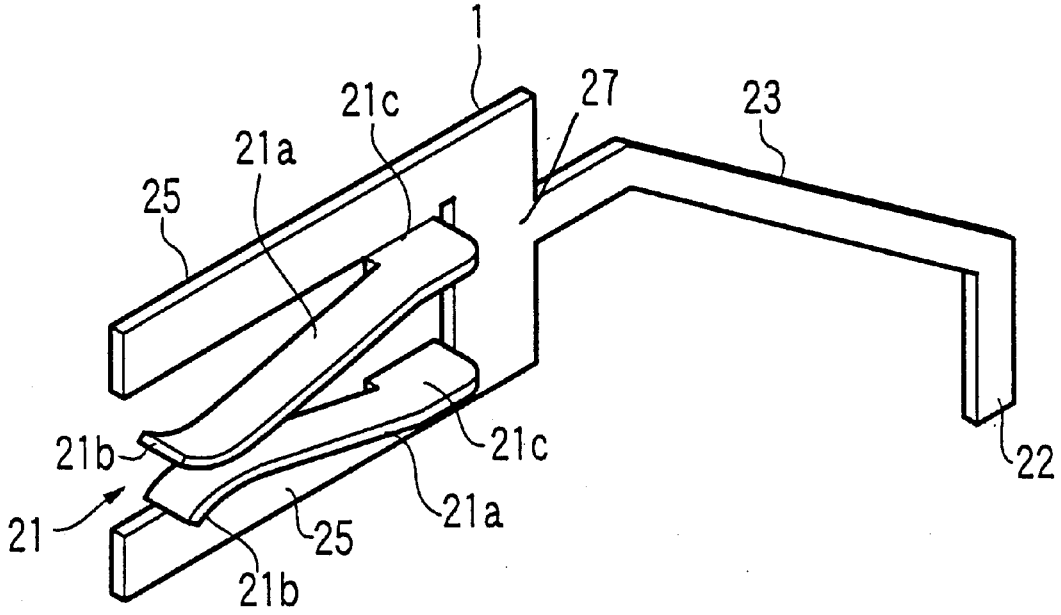
FIG. 7 is a perspective view showing another state of the ground socket in the manufacturing method of the connector according to the first embodiment of the present invention.
Figure 8:
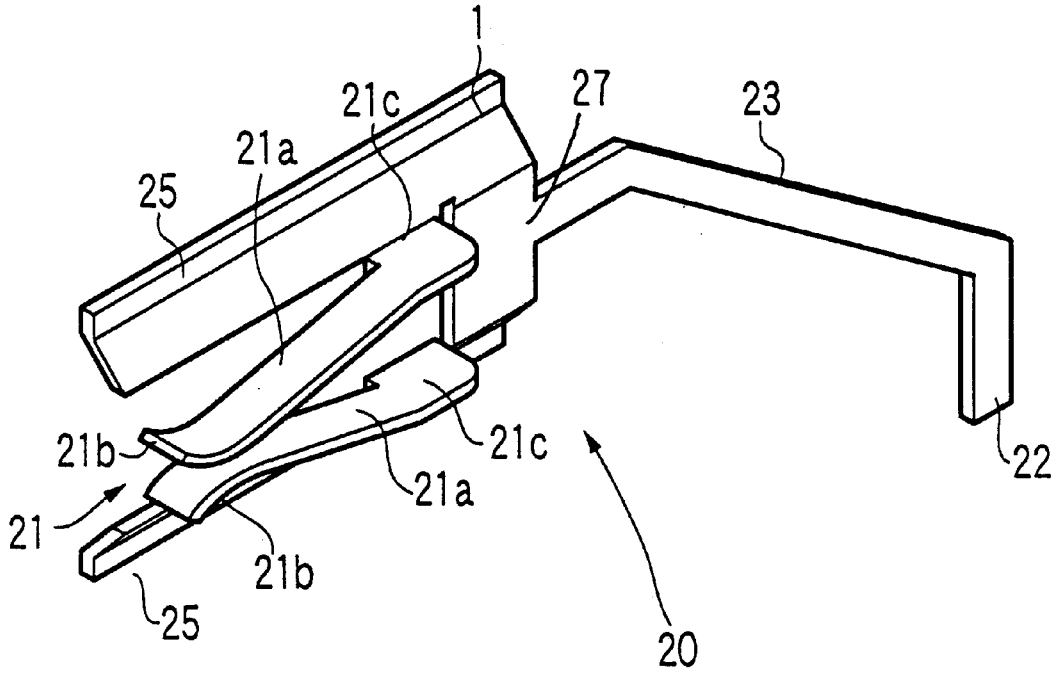
FIG. 8 is a perspective view showing still another state of the ground socket in the manufacturing method of the connector according to the first embodiment of the present invention.

The connector of the present invention has a perspective view similar to FIG. 1. FIG. 4 is a side cross sectional view showing the connector in the first embodiment of the present invention. FIG. 5 is a front cross sectional view along line B—B in FIG. 4. FIGS. 6 to 8 are perspective views showing manufacturing states of a ground socket used in the connector in the first embodiment of the present invention. In the drawings, same components as those shown in FIGS. 1 to 3 are allocated with same reference numerals.

Referring to FIGS. 4 and 5, the connector according to the first embodiment of the present invention will be described below. The connector in the first embodiment is composed of a contact lead section 11, 21, a lead terminal section 12, 22, a tail section 13, 23, and a base section 27, which are made of electrically conductive material. The connector in the first embodiment of the present invention is further composed of extending sections 25 provided at both sides of the contact lead section 21 of the ground socket 20. These extending sections 25 are bent in a gull-wing form into a direction opposite to the contact lead sections 21, so that the extending sections 25 are not in contact with the adjacent signal sockets 10. The tail sections 13, 23 are enclosed by a housing cover 32. The lead terminal sections 12, 22 project from the lower side of the housing cover 32. The lead terminal sections 12, 22 are inserted, for example, in through-holes (not shown) of a printed circuit board, and connected to the wiring of the printed circuit board. In both of the contact lead sections 11, 21 of the signal sockets 10 and ground sockets 20, male terminals arranged at same pitches are inserted as terminals to be connected. When electromagnetic wave is radiated from the signal socket 10, the electromagnetic wave is shielded by the extending sections 25 of the ground sockets 20, so that crosstalk can be reduced in the connector of the present invention.

As shown in FIG. 5, the sockets 10, 20 are embedded in a housing main body 31 made of synthetic resin so as to surround the periphery of the signal socket 30.

A method of manufacturing the ground socket 20 of the connector of the present invention will be described below.

First, as shown in FIG. 6, a T-slit 2 is formed in the central portion of a copper-alloy flat plate 1 connected the lead terminal section 22 and tail section 23. Thus, the flat plate 1 is divided into a base section 27 and another portion. Then, I-slits 3, 3 are formed at both sides of the slit 2 to form four portions. The four portions are for a pair of contact leads 21*a*, 21*a*, and a pair of extending sections 25, 25.

Next, as shown in FIG. 7, the lead end 21*b* of the contact lead 21*a* is bent to have a V-shape. Then, the contact leads 21*a* are bent at roots 21*c* at right angle to the extending sections 25. Thus, the contact lead section 21 is formed. The contact lead section 21 is designed to enclose a male terminal as the terminal to be connected so that the male terminal is held by the V-shapes of the pair of contact leads 21*a*, 21*a* by their spring or elastic force.

Finally, as shown in FIG. 8, the upper edge of the upper portion and a lower edge of the lower portion are bent in a direction opposite to the contact lead section 21 to have a gull-wing form. Thus, the extending section 25, 25 are formed. As a result, the ground socket 20 is completed.

Figure 9:
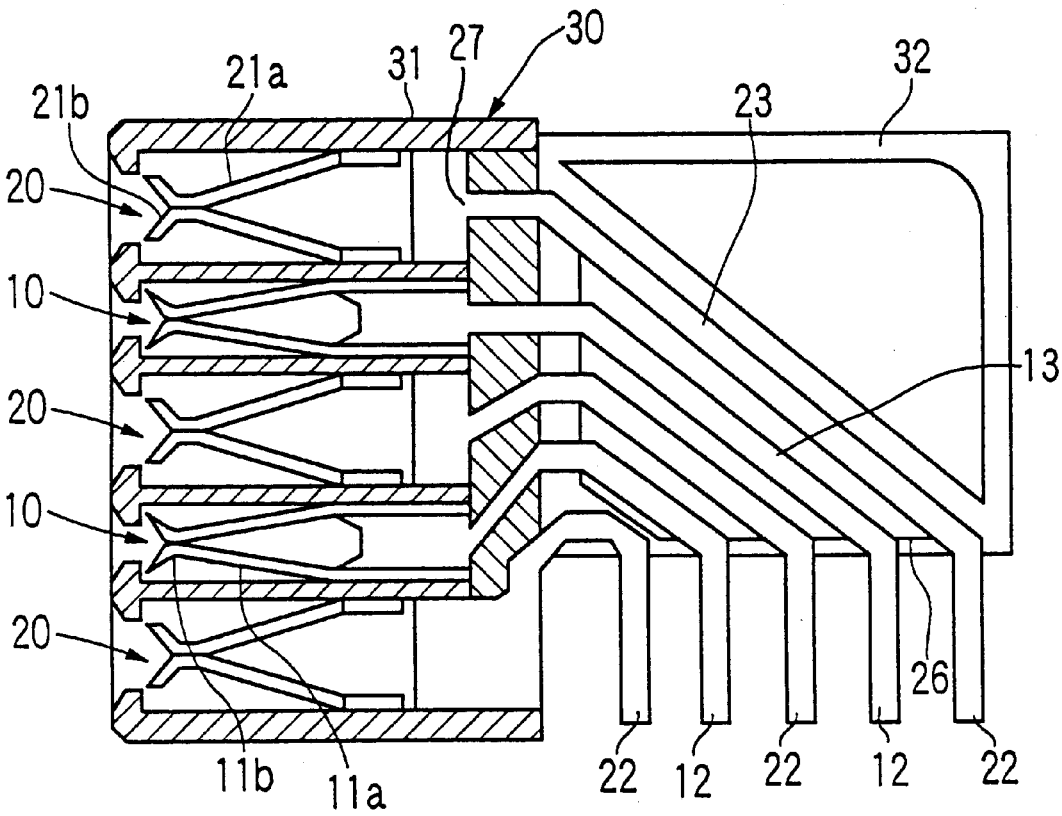
FIG. 9 is a sectional view showing a connector according to a second embodiment of the present invention.
Figure 10:
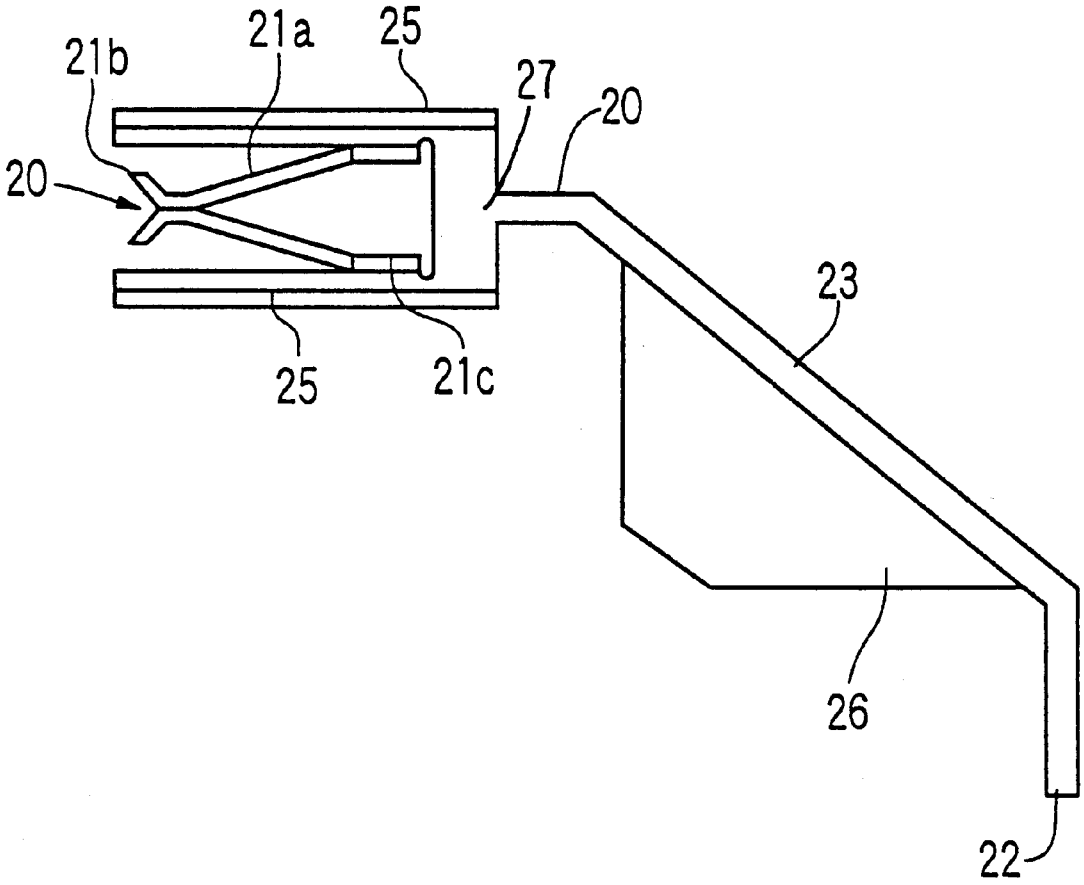
FIG. 10 is a front view showing a ground socket of the connector according to the second embodiment of the present invention.
Figure 11:
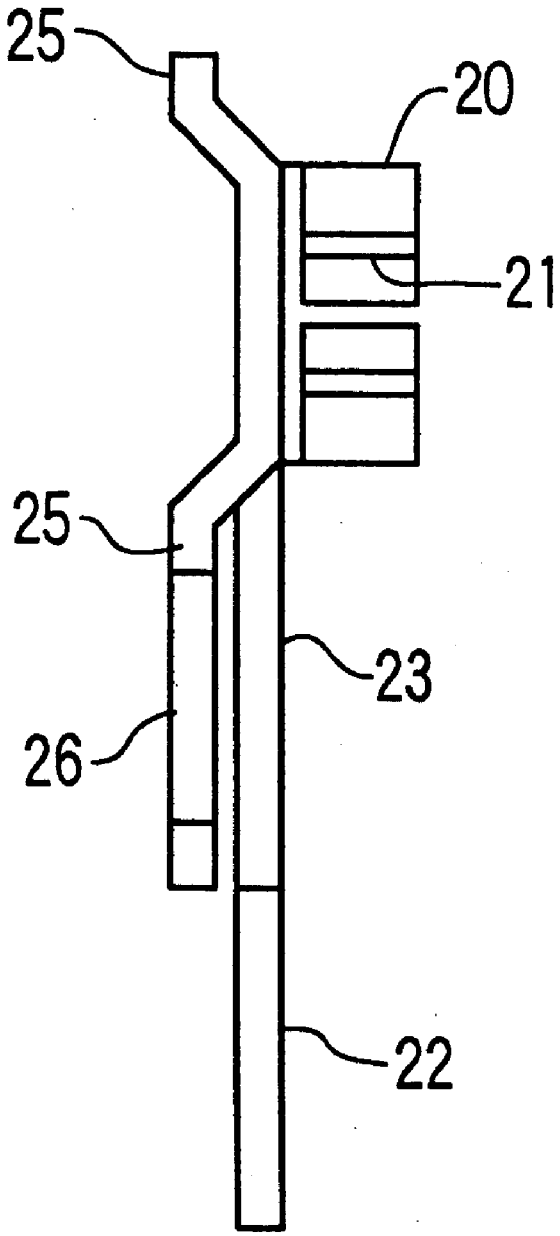
FIG. 11 is a side view showing the ground socket of the connector according to the second embodiment of the present invention.
Figure 12:
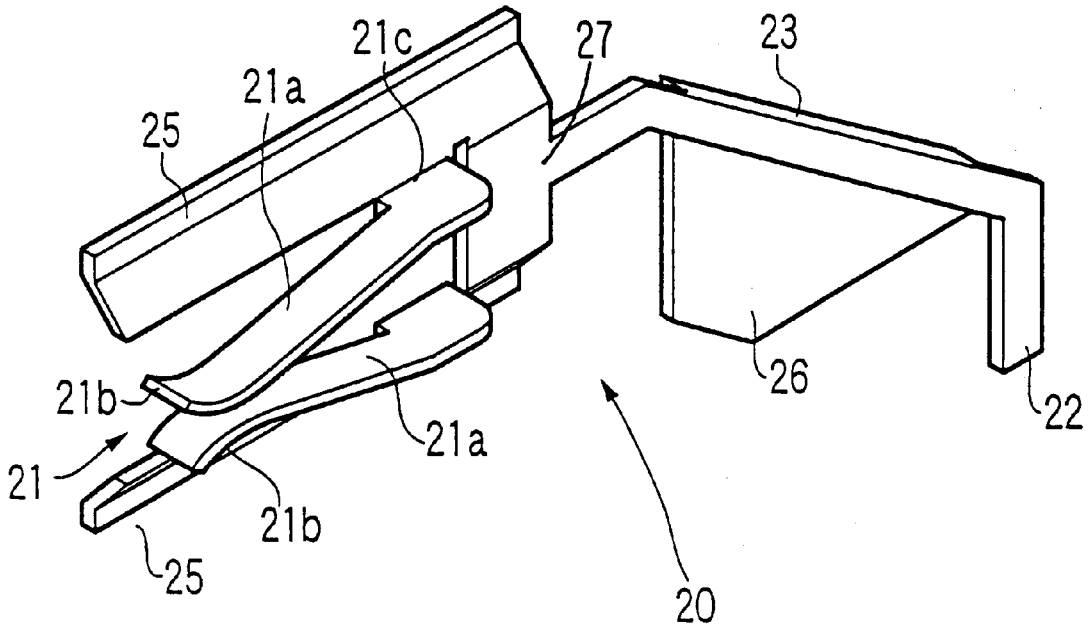
FIG. 12 is a perspective view showing the ground socket of the connector according to the second embodiment of the present invention.

A connector according to the second embodiment of the present invention is described below with reference to FIG. 9 to FIG. 12. FIG. 9 is a side sectional view showing the connector in the second embodiment. FIG. 10 is a side view showing a ground socket of the connector in the second embodiment of the present invention. FIG. 11 is a front view showing the ground socket of the connector in the second embodiment of the present invention. FIG. 12 is a perspective view showing the ground sockets of the connector in the second embodiment of the present invention. In the drawings, the same parts as in FIGS. 4 to 8 are allocated with same reference numerals.

It should be noted that the ground socket has the tail section 23 and the lead terminal section 22. However, the tail section 23 may be omitted. That is, the base section 27 extends straightly and is used as the lead terminal section 22.

As shown in FIG. 9 to FIG. 12, the connector of the second embodiment of the present invention has a gull-wing shielding plate 26 disposed in the tail section 23 of the ground socket 20. This shielding plate 26 is provided for only the uppermost ground socket of the plurality of sockets 20 arranged in the column direction. The shielding plate 26 covers the tail sections 23 of the other ground sockets 20 and tail sections 13 of the signal sockets 10. By the shielding plate 26, electromagnetic wave emitted in the tail sections 13 is shielded. Thus, the crosstalk can be reduced in the entire connector by the extending sections 25 and the shielding plate 26. The tail section of the lowermost socket 20 is short, and is hardly influenced by electromagnetic wave. Therefore, it is not required to cover with the shielding plate 26.

The present invention is not limited to these embodiments, and may be changed and modified in various forms within the technical scope described in the claims. For example, the contact lead section 21 of the ground socket may be formed as a male terminal having a square pin or a flat pin, instead of the female contact leads 21*a*. The lead terminal section 22 of the ground socket may be formed to have a straight shape without any tail section. A small shielding plate may be disposed in the tail sections of any of the ground sockets.

As described above, according to the present invention, since the electromagnetic wave emitted from the signal socket is shielded by the extending sections and/or shielding plate provided in the ground socket. Thus, the crosstalk can be reduced. Therefore, the device using the connector of the present invention can prevent malfunction or the like due to generation of crosstalk.

According to the manufacturing method of connector of the present invention, the extending sections can be formed only by forming slits in a flat plate to form four portions and bending the four portions. Therefore, the connector capable of reducing crosstalk can be manufactured easily.

What is claimed is:

1. A connector comprising:

signal sockets; and ground sockets, wherein said signal sockets and said ground sockets are made of electrically conductive material and alternately arrange in a column direction and a row direction, wherein each of said ground sockets has a first signal socket of said signal sockets arranged adjacent to said ground socket, a second signal socket of said signal sockets arranged adjacent to said ground socket and obliquely from said first signal socket, and a third signal socket of said signal sockets arranged adjacent to said ground socket and obliquely from said first signal socket, each of said signal sockets includes:

a contact lead section for an external signal lead to be connected; and a base section connected to said contact lead section of said signal socket, and each of said ground sockets includes:

a contact lead section for an external ground lead to be connected;

a first extending section extending between said first signal socket and one of said second and third signal sockets; and a base section connected to said contact lead section of said ground socket and said first extending section.

2. A connector according to claim 1, wherein said first extending section of said ground socket shields electromagnetic wave from said first signal socket to said one of said second and third signal sockets.

3. A connector according to claim 1, wherein said ground socket further includes a second extending section extending between said first signal socket and the other of said second and third signal sockets, and connected to said base section.

4. A connector according to claim 3, wherein said second extending section of said ground socket shields electromagnetic wave from said first signal socket to the other of said second and third signal sockets.

5. A connector according to claim 3, wherein said first and second extending sections are bent in a gull-wing form.

6. A connector according to claim 1, wherein said contact lead section of said ground socket includes a pair of contact leads opposing to each other, and each of said contact leads has a V-shape at a lead end portion thereof such that said contact leads are connected to said external lead with a spring force due to the V-shapes.

7. A connector according to claim 1, wherein said base section of each of said signal sockets and said ground sockets extends straightly.

8. A connector according to claim 7, wherein said base section is inserted in a through-hole in a printed circuit board.

9. A connector according to claim 1, wherein each of said sockets further comprises:

a lead terminal to be mounted to a printed circuit board; and a tail section connecting said base section of said socket and said lead terminal.

10. A connector according to claim 9, wherein an uppermost ground socket of said sockets arranged for one column has a shield plate extending downwardly from said tail section thereof.

11. A connector according to claim 9, wherein said shield plate of said uppermost ground socket covers said tail sections of said sockets arranged for one column to shield from electromagnetic wave.

12. A connector comprising:

a ground socket; and three signal sockets arranged around said ground socket, a first signal socket of said signal sockets arranged obliquely from a second signal socket of said signal sockets, the first signal socket of said signal sockets also arranged obliquely from a third signal socket of said signal sockets, and wherein each of said signal sockets includes:

a contact lead section for an external signal lead to be connected; and a base section connected to said contact lead section of said signal socket, and each of said ground sockets includes:

a contact lead section for an external ground lead to be connected;

a first extending section extending between the first signal socket and the second signal socket;

a second extending section extending between said first signal socket and the third signal socket; and a base section connected to said contact lead section of said ground socket and said first extending section.

13. A connector according to claim 12, wherein said first extending section shields electromagnetic wave from said first signal socket to said second signal socket, and said second extending section shields electromagnetic wave from said first signal socket to said third signal sockets.

14. A connector according to claim 12, wherein said contact lead section of said ground socket includes:

a pair of contact leads bent to be orthogonal to said base section of said ground socket and extending from said base section of said ground socket, wherein each of said contact leads has a V-shape at a lead end portion thereof such that said contact leads are connected to said external lead with a spring force due to the V-shapes, and wherein said first extending section extends from said base section of said ground socket in parallel to one of said contact leads, and said second extending section extends from said base section of said ground socket in parallel to the other of said contact leads, and wherein said first and second extending sections are bent in a gull-wing form.

15. A connector according to claim 12, wherein said base section of each of said signal sockets and said ground sockets extends straightly such that said base section is inserted in a through-hole in a printed circuit board.

16. A connector according to claim 12, wherein each of said sockets further comprises:

a lead terminal to be mounted to a printed circuit board; and a tail section connecting said base section of said socket.

17. A connector according to claim 16, wherein said ground socket is an uppermost ground socket of ground sockets arranged for one column and has a shield plate extending downwardly from said tail section thereof, such that said shield plate of said uppermost ground socket covers said tail sections of said sockets arranged for one column to shield from electromagnetic wave.

18. A manufacturing method of a connector having a socket, comprising:

forming a T-slit in a central portion of a flat plate and an I-slit at both sides of said T-slit to form a base section and first to fourth portions connected to said base section;

forming a V-shape at an end portion of each of said contact leads such that said contact leads hold a contact with an external lead inserted into said socket with elastic force of said V shapes;

bending said second and third portions orthogonally to extend in parallel to said first and fourth portions to form a pair of contact leads; and bending said first and fourth portions in a direction opposite to said second and third portion to have a gull-wing form.

* * * * *